US007473100B2

(12) United States Patent
Moritake

(10) Patent No.: US 7,473,100 B2
(45) Date of Patent: Jan. 6, 2009

(54) CONNECTOR

(75) Inventor: Toshiyuki Moritake, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 11/895,111

(22) Filed: Aug. 23, 2007

(65) Prior Publication Data

US 2008/0057744 A1 Mar. 6, 2008

(30) Foreign Application Priority Data

Aug. 29, 2006 (JP) ..... 2006-232580

(51) Int. Cl.
*H01R 12/00* (2006.01)

(52) U.S. Cl. ..... 439/62; 439/329; 439/493

(58) Field of Classification Search ..... 439/61–62, 439/329, 493, 489, 498
See application file for complete search history.

(56) References Cited

U.S. PATENT DOCUMENTS 5,501,610 A * 3/1996 Ikemoto ..... 439/498
6,250,966 B1 * 6/2001 Hashimoto et al. ..... 439/631
6,722,915 B1 * 4/2004 McAlonis et al. ..... 439/498
7,281,943 B1 * 10/2007 Yamaji ..... 439/495

FOREIGN PATENT DOCUMENTS

JP 2004-79347 A 3/2004

* cited by examiner

*Primary Examiner*—Truc T Nguyen
(74) *Attorney, Agent, or Firm*—Frishauf, Holtz, Goodman & Chick, P.C.

(57) ABSTRACT

A connector capable of detecting whether or not two connected objects each having a substantially plate-like shape have been normally inserted into a housing. A first insertion-detecting contact and a second insertion-detecting contact are arranged adjacent to each other in the housing. Contact portions 5*c* and 5*f* are provided in the first insertion-detecting contact. Contact portions 7*c* and 7*f* are provided in the second insertion-detecting contact. The contact portions 5*c* and 7*c* are configured to be electrically connected to a first FPC when the first FPC is normally inserted into the housing. When a second FPC is normally inserted into the housing, the contact portion 5*f* is urged by the second FPC, to be brought into contact with the contact portion 7*f*.

4 Claims, 9 Drawing Sheets

CONNECTOR

BACKGROUND OF THE INVENTION

1. Field of the Invention

This invention relates to a connector, and more particularly to a connector for electrically connecting two connected objects each having a substantially plate-like shape.

2. Prior Art

Conventionally, there has been proposed a connector provided with a holding member, a card insertion-detecting terminal, a common terminal, and a write protect-detecting terminal (see Japanese Laid-Open Patent Publication (Kokai) No. 2004-79347 (Paragraph numbers [0030]to [0035]).

The holding member has one end formed with a recess for accommodating a memory card (connected object having a substantially plate-like shape). The other end of the holding member is formed with a printed board-inserting hole for accommodating a printed board (connected object having a substantially plate-like shape).

The card insertion-detecting terminal, the common terminal, and the write protect-detecting terminal are held by the holding member. The common terminal is positioned between the card insertion-detecting terminal and the write protect-detecting terminal.

When the memory card is inserted into the recess, the card insertion-detecting terminal is pressed against the common terminal by the memory card, whereby the card insertion-detecting terminal and the common terminal are electrically connected to each other. This makes it possible to detect that the memory card has been normally inserted into the recess.

When the memory card is inserted into the recess, if a movable member provided on a side portion of the memory card is positioned toward the terminal of the memory card, the write protect-detecting terminal is pressed against the common terminal by the movable member, whereby the write protect-detecting terminal and the common terminal are electrically connected to each other. As a result, it is possible to detect whether or not writing to the memory card is prohibited.

Although in the above-described connector, it is possible to detect whether or not the memory card has been normally inserted to a predetermined position in the holding member, it is impossible to detect whether or not the printed board has been normally inserted to a predetermined position in the holding member.

SUMMARY OF THE INVENTION

The present invention has been made in view of these circumstances, and an object thereof is to provide a connector which is capable of detecting whether or not two connected objects each having a substantially plate-like shape have been normally inserted into a housing.

To attain the above object, the present invention provides a connector comprising a housing having a first receiving portion for receiving a first connected object having a substantially plate-like shape, and a second receiving portion for receiving a second connected object having a substantially plate-like shape, a first insertion-detecting contact disposed in the housing, and a second insertion-detecting contact disposed in the housing at a location adjacent to the first insertion-detecting contact, wherein the first insertion-detecting contact includes a first contact portion disposed in the first receiving portion, and a second contact portion urged by the second connected object when the second connected object has been normally inserted into the second receiving portion, wherein the second insertion-detecting contact includes a third contact portion disposed in the first receiving portion, and a fourth contact portion brought into contact with the second contact portion when the second connected object has been normally inserted into the second receiving portion, and wherein when the first connected object is not inserted to a predetermined position in the first receiving portion, at least one of the first contact portion and the third contact portion is not in contact with the first connected object, whereas when the first connected object is inserted to the predetermined position in the first receiving portion, both the first contact portion and the third contact portion are brought into contact with the first connected object.

With the arrangement of the connector according to the present invention, when the first connected object is not inserted to the predetermined position in the first receiving portion, at least one of the first contact portion and the third contact portion is not in contact with the first connected object, whereas when the first connected object is inserted to the predetermined position in the first receiving portion, both the first contact portion and the third contact portion are brought into contact with the first connected object. Further, the fourth contact portion is brought into contact with the second contact portion when the second connected object has been normally inserted into the second receiving portion. Therefore, it is possible to detect whether or not the first and second connected objects have been normally inserted into the housing, based on whether or not the first and third contact portions are in contact with the first connected object, and whether or not the second contact portion and the fourth contact portion are in contact with each other.

Preferably, a positioning portion for positioning the second connected object with respect to the second contact portion is provided in the housing.

Preferably, the connector further comprises an actuator connected to the housing such that the actuator can be pivotally moved between a closed position where the actuator presses the second connected object against signal contacts held by the housing and an open position where the actuator permits the second connected object to be inserted into or removed from the housing.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing a preferred embodiment thereof.

Figure 1:
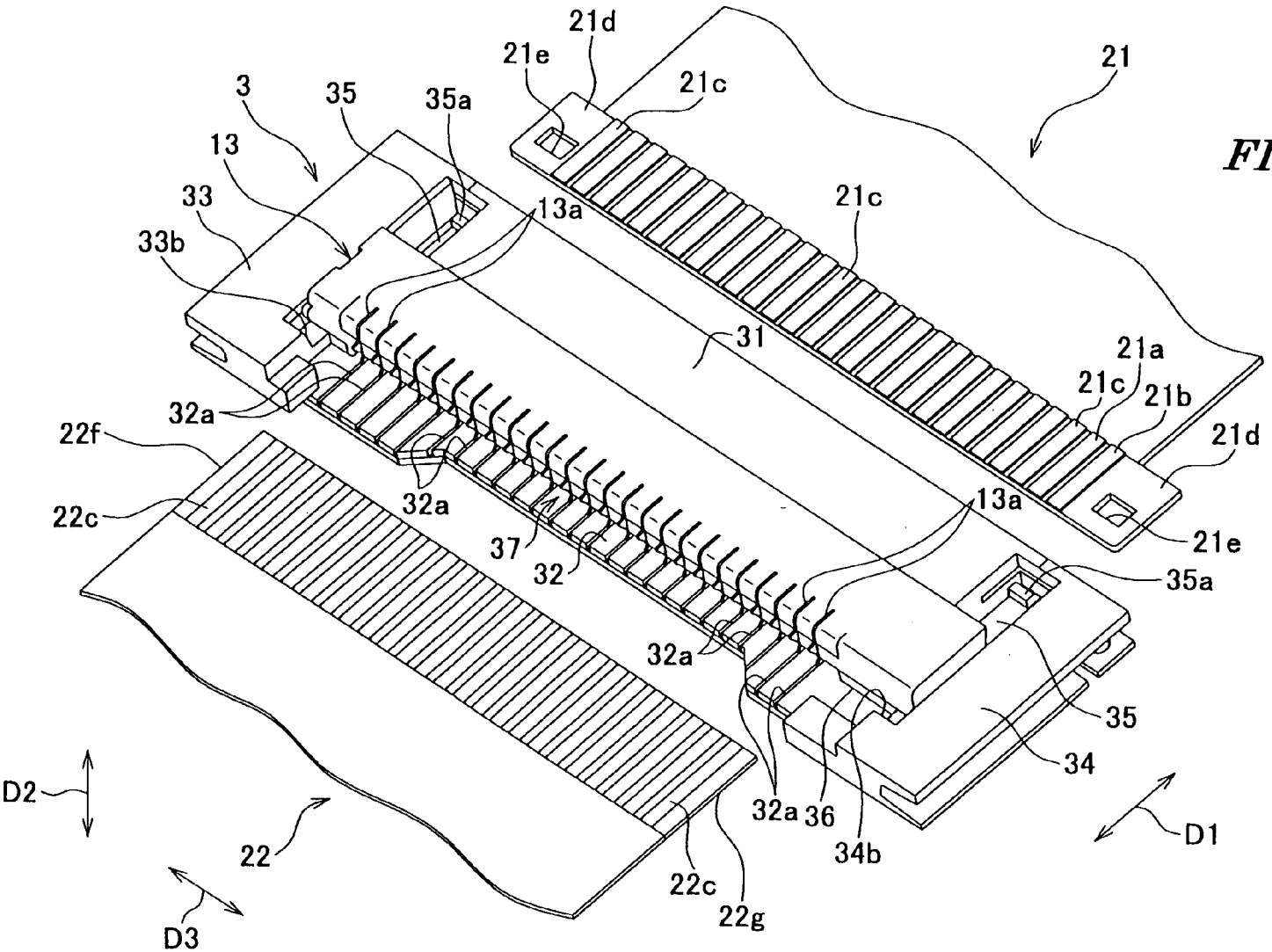
FIG. 1 is a perspective view of a connector according to an embodiment of the present invention.
Figure 2:
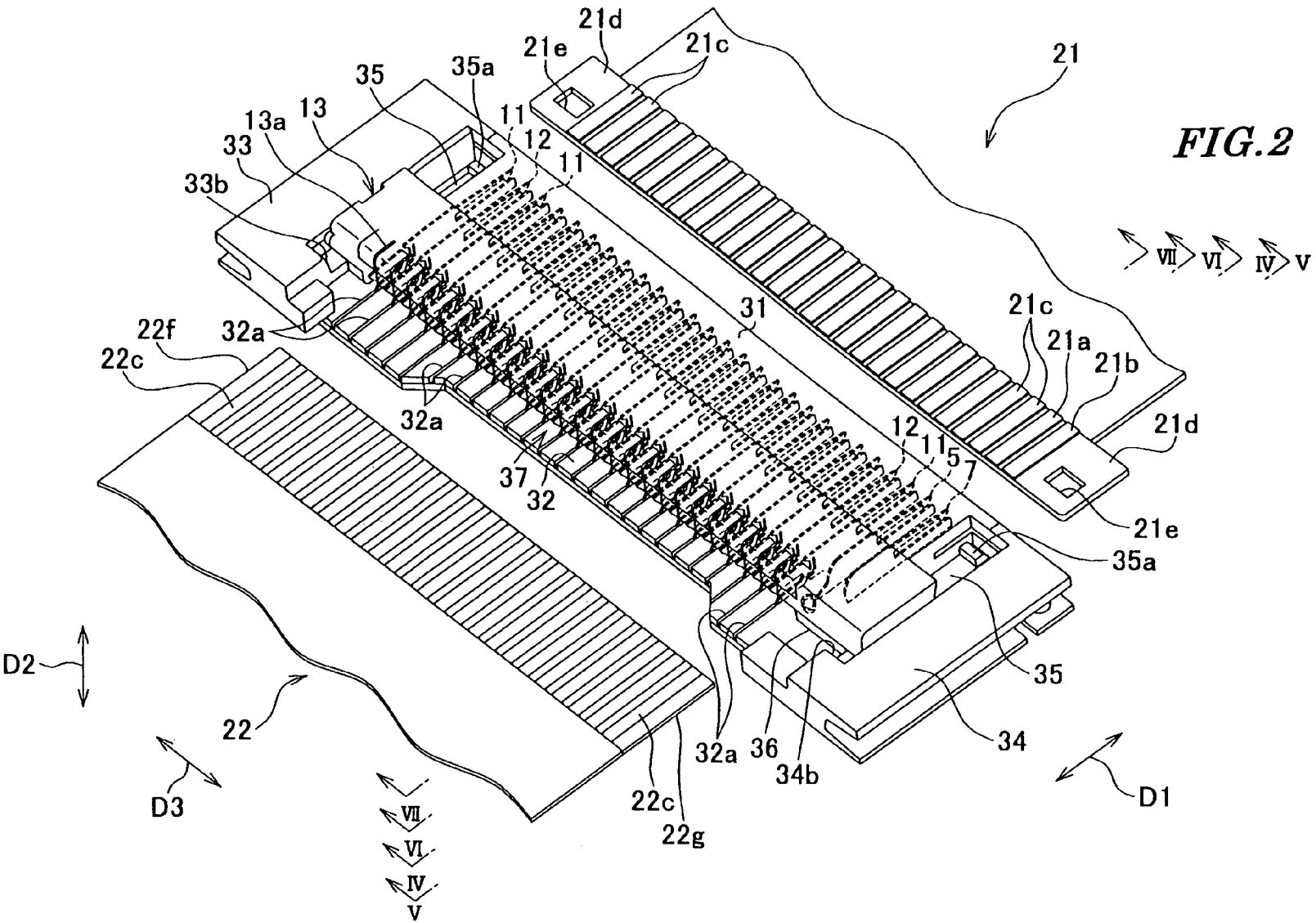
FIG. 2 is a perspective view of the FIG. 1 connector with an interior thereof in a seen-through state.
Figure 3:
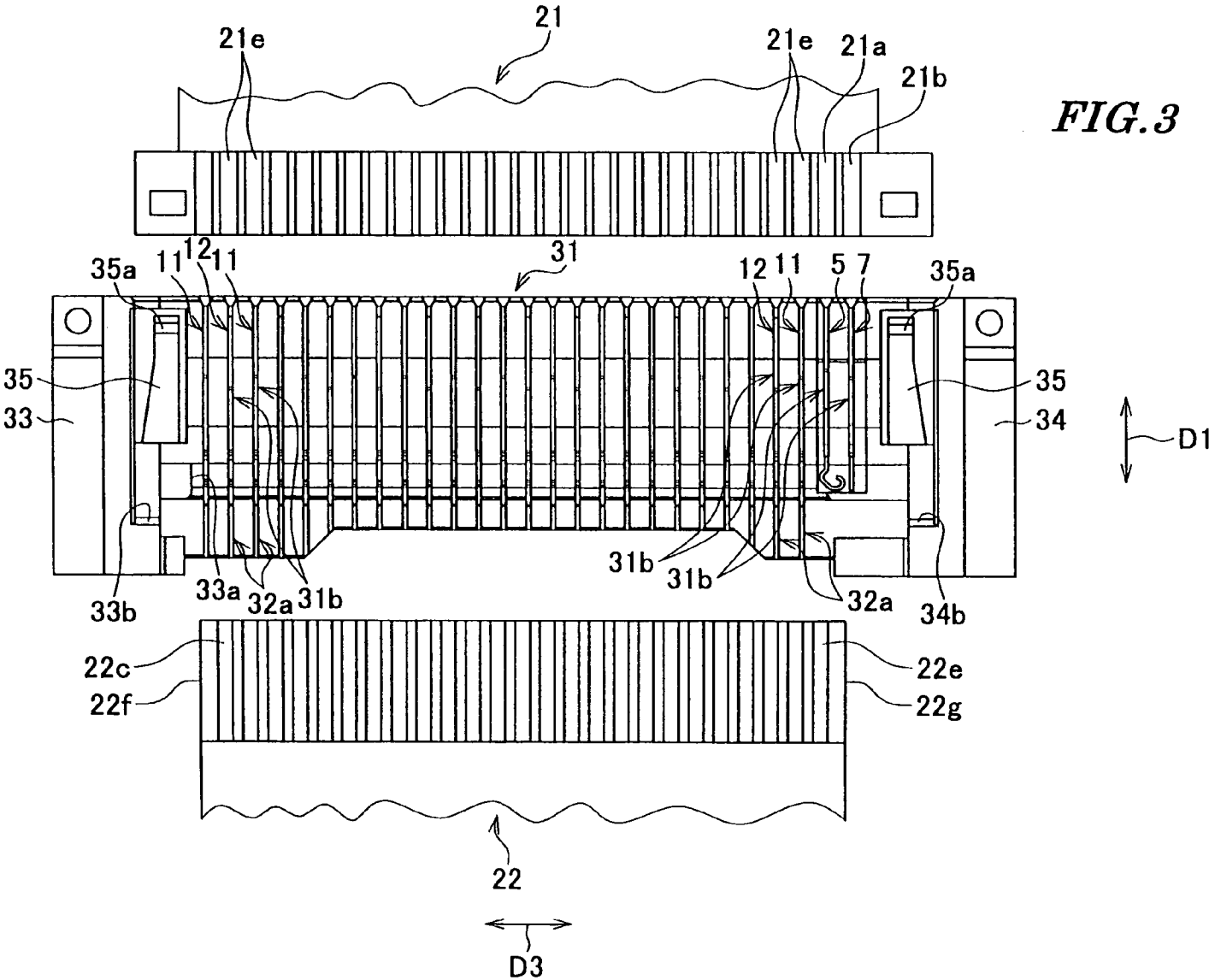
FIG. 3 is a plan view of the FIG. 1 connector with a ceiling removed from a housing thereof.

Referring to FIGS. 1 to 3, the connector is comprised of the housing 3, the first insertion-detecting contact 5, the second insertion-detecting contact 7, signal contacts 11, signal contacts 12, and the actuator 13, and connects a first FPC (Flexible Printed Circuit) 21, which is a first connected object, and a second FPC 22, which is a second connected object, to each other.

The first FPC 21 has a substantially plate-like shape, and is formed with a pair of insertion-detecting terminals 21*a* and 21*b*, and a plurality of signal terminals 21*c*. The insertion-detecting terminals 21*a* and 21*b* are arranged at one end of the first FPC 21 in the terminal arrangement direction. The insertion-detecting terminals 21*a* and 21*b* are terminals of an insertion-detecting circuit, not shown. Further, the first FPC 21 has locking pieces 21*d* formed on opposite ends thereof in the terminal arrangement direction. Each locking piece 21*d* is formed with a locking hole 21*e*.

The second FPC 22 has a substantially plate-like shape, and has one end thereof formed with a plurality of signal terminals 22*c*. The number of the signal terminals 22*c* is the same as that of the signal terminals 21*c*.

The housing 3 is comprised of a holding portion 31, a plate-like portion 32, and side portions 33 and 34. The holding portion 31 has a plate-like shape substantially rectangular in cross section. The holding portion 31 is formed with a first receiving portion 31*a* for receiving one end of the first FPC 21 (see FIGS. 4 to 8). Further, the holding portion 31 has a plurality of contact-accommodating chambers 31*b* formed at intervals equally spaced in the longitudinal direction thereof. The contact-accommodating chambers 31*b* communicate with the first receiving portion 31*a*. Two of the contact-accommodating chambers 31*b*, arranged at one end of the holding portion 31 in the longitudinal direction thereof, accommodate the first and second insertion-detecting contact 5 and 7, respectively, and the other contact-accommodating chambers 31*b* accommodate the signal contacts 11 and 12, referred to hereinafter, alternately.

The plate-like portion 32 is connected to the holding portion 31. The plate-like portion 32 is formed with a plurality of grooves 32*a*, each of which extends in fitting and removing directions D1, and communicates with an associated one of the contact-accommodating chambers 31*b*.

The side portion 33 has an inner side surface formed with a positioning protrusion (positioning portion) 33*a*. The positioning protrusion 33*a* is in slidable contact with one side surface 22*f* of the second FPC 22, for positioning the other side surface 22*g* of the second FPC 22 with respect to a contact portion 5*f*, referred to hereinafter, of the first insertion-detecting contact 5.

The side portions 33 and 34 are formed with sloping surfaces 33*b* and 34*b*, respectively. The sloping surfaces 33*b* and 34*b* abut the actuator 13 to thereby hold the actuator 13 in an open state.

Locking arms 35 are formed between the side portion 33 and the holding portion 31 and between the side portion 34 and the holding portion 31, respectively. Each locking arm 35 has a foremost end formed with a nail 35*a*. The locking arm 35 extends in the fitting and removing directions D1 such that it can perform a swinging motion in the vertical directions D2 of the housing 3. When the first FPC 21 is normally inserted into the first receiving portion 31*a*, the nail 35*a* is inserted into the locking hole 21*e* of the first FPC 21, whereby the first FPC 21 is locked to the housing 3.

The holding portion 31 has one end formed with a overhang portion 36. The overhang portion 36 is formed with an accommodating space 36*a* (see FIGS. 4 and 5). The accommodating space 36*a* is provided for accommodating the contact portion 5*f* and a contact portion 7*f*, referred to hereinafter, of the first and second insertion-detecting contacts 5 and 7, and communicates with the contact-accommodating chambers 31*b*, and a space 37, described hereinafter.

Figure 6:
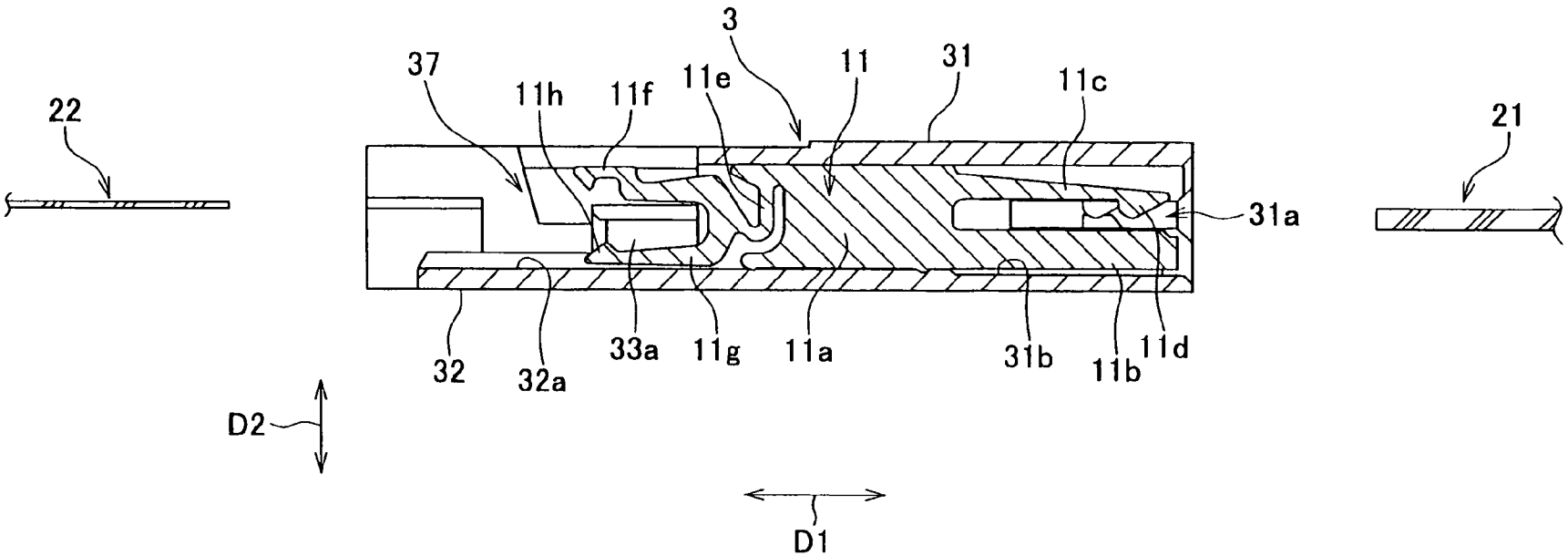
FIG. 6 is a cross-sectional view taken on line VI-VI of FIG. 2 with the actuator removed from the FIG. 1 connector.
Figure 7:
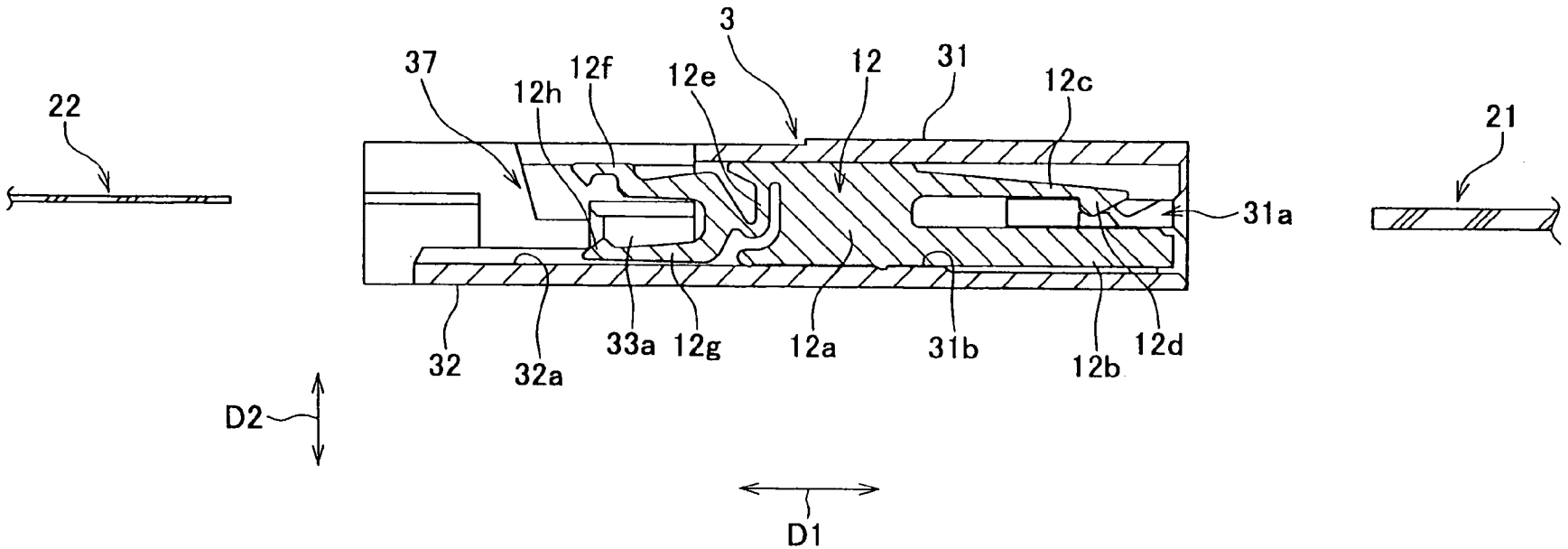
FIG. 7 is a cross-sectional view taken on line VII-VII of FIG. 2 with the actuator removed from the FIG. 1 connector.

The space 37 exists above the plate-like portion 32 (see FIGS. 6 and 7). An upper portion of the space 37 is a space for accommodating the actuator 9, and a lower portion thereof is a space (second receiving space) for removably receiving the second FPC 22.

Figure 4:
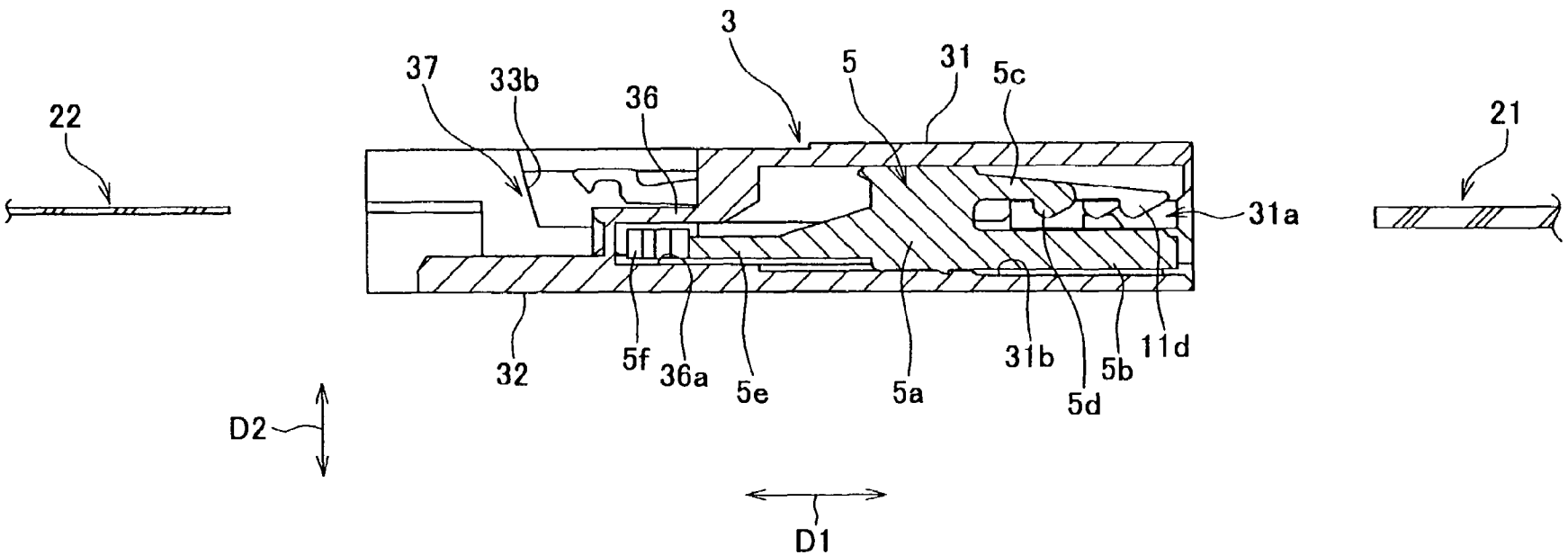
FIG. 4 is a cross-sectional view taken on line IV-IV of FIG. 2 with an actuator removed from the connector.

Referring to FIG. 4, the first insertion-detecting contact 5 has a substantially rectangular trunk 5*a*. The trunk 5*a* is press-fitted into an associated one of the contact-accommodating chambers 31*b*. The trunk 5*a* has one end thereof connected to a leg 5*b* and a contact portion (first contact portion) 5*c*. The contact portion 5*c* has a foremost end formed with a contact point 5*d*. The contact point 5*d* is brought into contact with the insertion-detecting terminal 21*a* when the first FPC 21 is normally inserted into the first receiving portion 31*a* until it reaches a predetermined position. To this end, the contact point 5*d* is at a location deeper than a contact point 11*d* of each signal contact 11, described hereinafter, (toward the space 37) in the first receiving portion 31*a*. To the other end of the trunk 5*a* is connected a swing arm 5*e*. The swing arm 5*e* can perform a swinging motion in the directions D3 of the width of the housing 3 (see FIG. 1). The swing arm 5*e* has a foremost end formed with a contact portion (second contact portion) 5*f*.

Figure 5:
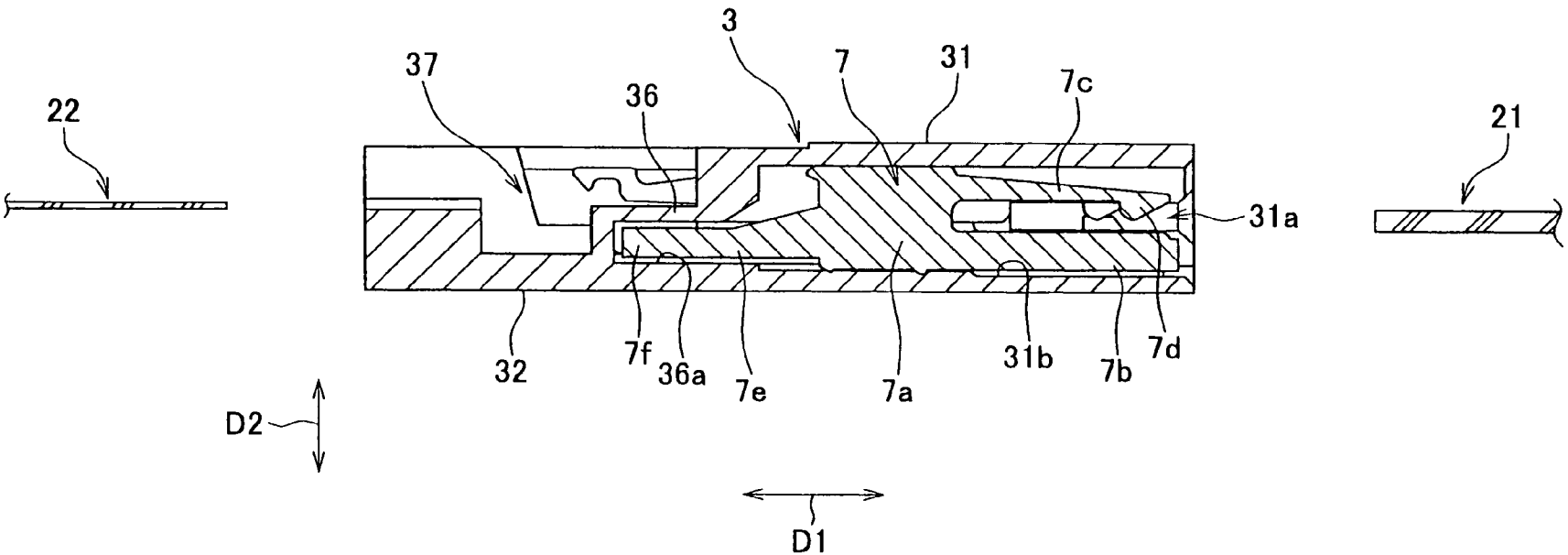
FIG. 5 is a cross-sectional view taken on line V-V of FIG. 2 with the actuator removed from the FIG. 1 connector.

As shown in FIG. 5, the second insertion-detecting contact 7 has a substantially rectangular trunk 7*a*. The trunk 7*a* is press-fitted into an associated one of the contact-accommodating chambers 31*b*. The trunk 7*a* has one end thereof connected to a leg 7*b* and a contact portion (third contact portion) 7*c*. The contact portion 7*c* has a foremost end formed with a contact point 7*d*. The contact point 7*d* is brought into contact with the insertion-detecting terminal 21*b* as soon as the first FPC 21 is inserted into the first receiving portion 31*a*. To the other end of the trunk 7*a* is connected a swing arm 7*e*. The swing arm 7*e* can perform a swinging motion in the directions D3 of the width of the housing 3. The swing arm 7*e* has a foremost end formed with a contact portion (fourth contact portion) 7*f*.

As shown in FIG. 6, each signal contact 11 has a substantially rectangular trunk 11*a*. The trunk 11*a* is press-fitted into an associated one of the contact-accommodating chambers 31*b*. The trunk 11*a* has one end thereof connected to a leg 11*b* and a contact portion 11*c*. The contact portion 11*c* has a foremost end formed with a contact point 11*d*. The contact point 11*d* is brought into contact with an associated one of the signal terminals 21*c* of the first FPC 21. Connected to the other end of the trunk 11*a* are a holding arm 11*f* and a contact portion 11*g* via a connecting portion 11*e*. The contact portion 11*g* has a foremost end formed with a contact point 11*h*. The contact point 11*h* is brought into contact with an associated one of the signal terminals 22*c* of the second FPC 22.

As shown in FIG. 7, each signal contact 12 has a substantially rectangular trunk 12*a*. The trunk 12*a* is press-fitted into an associated one of the contact-accommodating chambers 31*b*. The trunk 12*a* has one end thereof connected to a leg 12*b* and a contact portion 12*c*. The contact portion 12*c* has a foremost end formed with a contact point 12*d*. The contact point 12*d* is brought into contact with an associated one of the signal terminals 21*c* of the first FPC 21. Connected to the other end of the trunk 12*a* are a holding arm 12*f* and a contact portion 12*g* via a connecting portion 12*e*. The contact portion 12*g* has a foremost end formed with a contact point 12*h*. The contact point 12*h* is brought into contact with an associated one of the signal terminals 22*c* of the second FPC 22.

The signal contact 11 and the signal contact 12 are different from each other only in that the contact portions 11*c* and 12*c* have different lengths. The length of the signal terminal 12*c* is shorter than that of the signal terminal 11*c*. Therefore, the contact point 12*d* is positioned closer to the second FPC 22 than the contact point 11*d* is.

The actuator 13 has a plurality of grooves 13*a* (see FIG. 1) formed at intervals equally spaced in the longitudinal direction thereof. The grooves 13*a* are continuous with the associated contact-accommodating chambers 31*b*, respectively. The actuator 13 is formed with a shaft, not shown, which extends in the longitudinal direction thereof, and crosses the grooves 13*a*. The shaft is substantially elliptical in cross section, and functions as a cam. The shaft is pivotally held by the holding arms 11*f* and 12*f* of the signal contacts 11 and 12 inserted into the grooves 13*a*, whereby the actuator 13 is pivotally connected to the housing 3 by the signal contacts 11 and 12. The actuator 13 can be pivotally moved between a closed position (position shown in FIG. 1) and an open position (position in which the actuator 13 is supported by the sloping surfaces 33*b* and 34*b*). When the actuator 13 is in the open position, the direction of the major axis of the shaft of the actuator 13 becomes parallel to the fitting and removing directions D1, whereby the second FPC 22 can be inserted in or removed from between the shaft and the respective contact portions 11*g* and 12*g* of the signal contacts 11 and 12. When the actuator 13 is in the closed position, the direction of the major axis of the shaft of the actuator 13 becomes parallel to the vertical directions D2. As a result, the shaft presses the signal terminals 22*c* of the second FPC 22 against the contact points 11*h* and 12*h* of the contact portions 11*g* and 12*g*, whereby the signal contacts 11 and 12 are electrically connected to the second FPC 22.

It should be noted that the configuration and the operation of the actuator 13 are known techniques (see e.g. Japanese Laid-Open Patent Publication (Kokai) No. 2006-147491).

Next, a description will be given of the insertion-detecting operation of the connector according to the present embodiment.

Figure 8:
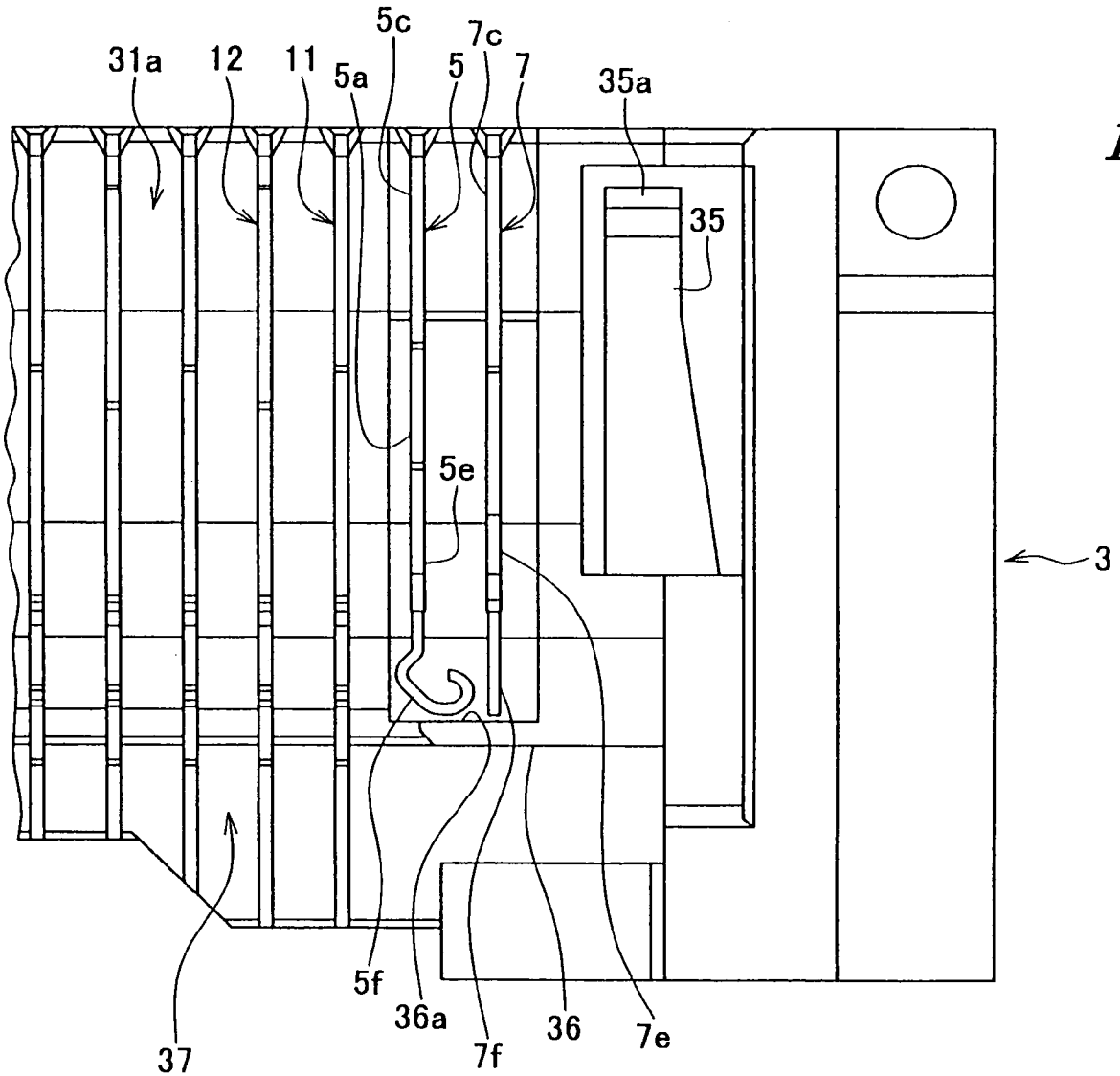
FIG. 8 is an enlarged fragmentary view of FIG. 3.

When the second FPC 22 is not inserted into the space 37, as shown in FIG. 8, the contact portion 5*f* of the first insertion-detecting contact 5 is away from the contact portion 7*f* of the second insertion-detecting contact 7.

Figure 9:
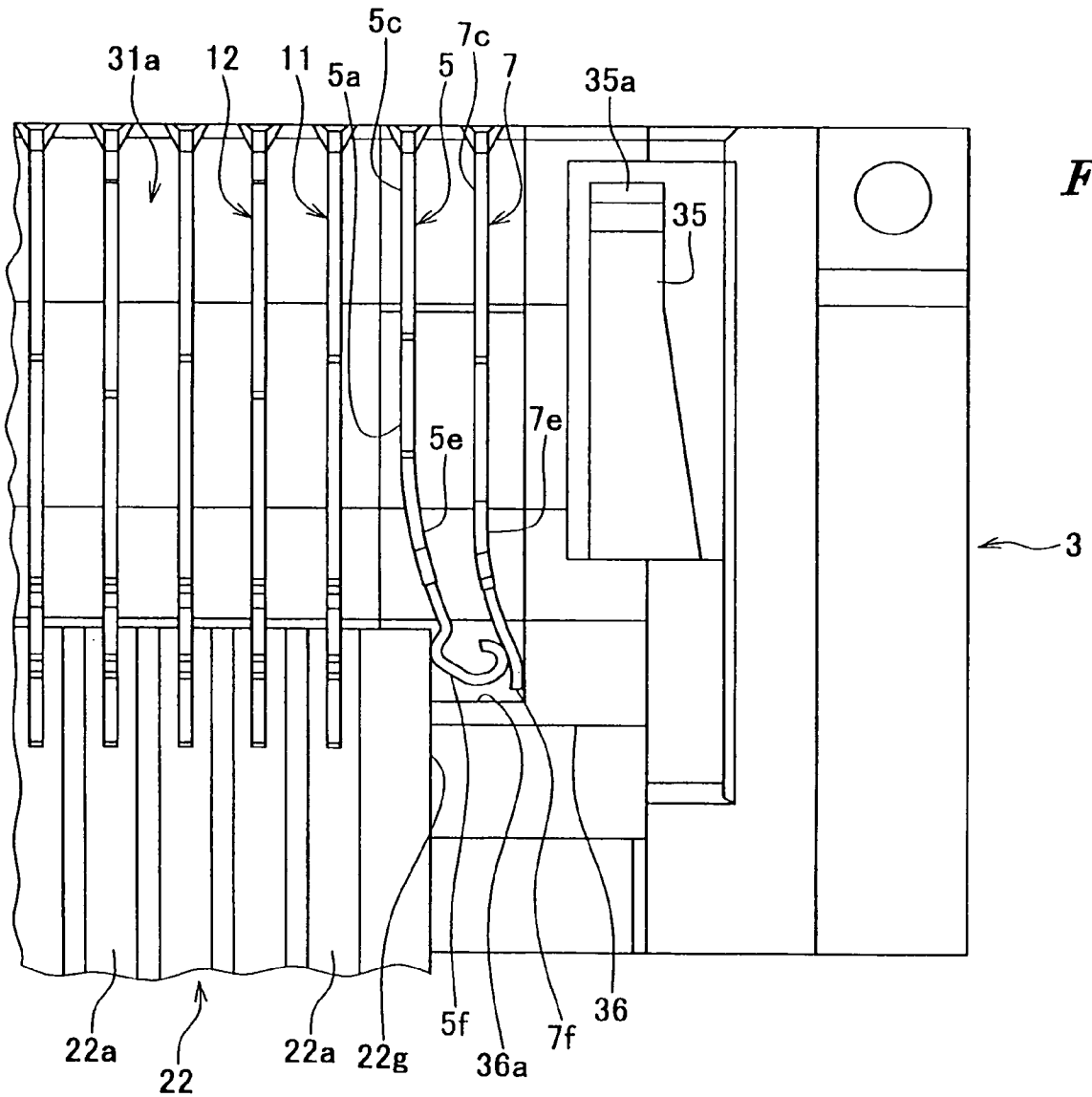
FIG. 9 is an enlarged fragmentary view of the connector with first and second insertion-detecting contacts brought into contact with each other by a second FPC.

When the second FPC 22 is inserted into the space 37, as shown in FIG. 9, the contact portion 5*f* of the first insertion-detecting contact 5 is urged by the other side surface 22*g* of the second FPC 22, and is brought into contact with the contact portion 7*f* of the second insertion-detecting contact 7. At this time, although not shown in FIG. 9, if the first FPC 21 is normally inserted into the first receiving portion 31*a*, the insertion-detecting terminals 21*a* and 21*b* of the first FPC 21 are connected to each other by the first and second insertion-detecting contacts 5 and 7, whereby it is possible to detect that the first FPC 21 and the second FPC 22 have been normally inserted into the housing 3.

It should be noted that the insertion-detecting terminals 21*a* and 21*b* are connected to a detection circuit, not shown, for generating a detection signal.

Assuming that the first FPC 21 is not normally inserted into the first receiving portion 31*a*, the insertion-detecting terminals 21*a* and 21*b* of the first FPC 21 are not connected to each other by the first and second insertion-detecting contacts 5 and 7, and therefore the detection signal is not generated which notifies the user that the first FPC 21 and the second FPC 22 have been normally inserted into the housing 3.

Further, even if the first FPC 21 is normally inserted into the first receiving portion 31*a*, if the second FPC 22 is not normally inserted into the space 37, the contact portion 5*f* of the first insertion-detecting contact 5 is not brought into contact with the contact portion 7*f* of the second insertion-detecting contact 7, so that the insertion-detecting terminals 21*a* and 21*b* of the first FPC 21 are not connected to each other by the first and second insertion-detecting contacts 5 and 7, and hence the detection signal is not generated which notifies the user that the first FPC 21 and the second FPC 22 have been normally inserted into the housing 3.

As described hereinabove, according to the present embodiment, it is possible to detect whether or not the first FPC 21 and the second FPC 22 have been normally inserted into the housing 3.

Further, according to the present embodiment, since the second FPC 22 is positioned by the positioning protrusion 33*a*, it is possible to easily perform an operation for inserting the second FPC 22 into the space 37.

Furthermore, according to the present embodiment, since the actuator 13 is provided, the second FPC 22 can be inserted into the space 37 without any insertion force.

It should be noted that although the FPCs 21 and 22 are employed as the first and second connected objects, this is not limitative, but FFCs (Flexible Flat Cables) and memory cards, for example, may be employed as the first and second connected objects.

It is further understood by those skilled in the art that the foregoing are the preferred embodiments of the present invention, and that various changes and modification may be made thereto without departing from the spirit and scope thereof.

What is claimed is:

1. A connector comprising:

a housing having a first receiving portion for receiving a first connected object having a substantially plate-like shape, and a second receiving portion for receiving a second connected object having a substantially plate-like shape;

a first insertion-detecting contact disposed in said housing; and a second insertion-detecting contact disposed in said housing at a location adjacent to said first insertion-detecting contact, wherein said first insertion-detecting contact includes a first contact portion disposed in said first receiving portion, and a second contact portion urged by the second connected object when the second connected object has been normally inserted into said second receiving portion, wherein said second insertion-detecting contact includes a third contact portion disposed in said first receiving portion, and a fourth contact portion brought into contact with said second contact portion when the second connected object has been normally inserted into said second receiving portion, and wherein when the first connected object is not inserted to a predetermined position in said first receiving portion, at least one of said first contact portion and said third contact portion is not in contact with the first connected object, whereas when the first connected object is inserted to the predetermined position in said first receiving portion, both said first contact portion and said third contact portion are brought into contact with the first connected object.

2. A connector as claimed in claim 1, wherein a positioning portion for positioning the second connected object with respect to said second contact portion is provided in said housing.

3. A connector as claimed in claim 1, further comprising an actuator connected to said housing such that said actuator can be pivotally moved between a closed position where said actuator presses the second connected object against signal contacts held by said housing and an open position where said actuator permits the second connected object to be inserted into or removed from said housing.

4. A connector as claimed in claim 2, further comprising an actuator connected to said housing such that said actuator can be pivotally moved between a closed position where said actuator presses the second connected object against signal contacts held by said housing and an open position where said actuator permits the second connected object to be inserted into or removed from said housing.

* * * * *